US008656883B2

(12) United States Patent
Raasch et al.

(10) Patent No.: US 8,656,883 B2
(45) Date of Patent: Feb. 25, 2014

(54) RECOIL STARTER ASSEMBLY FOR AN ENGINE

(75) Inventors: Jason J. Raasch, Cedarburg, WI (US); Gregory L. Hupfer, Jackson, WI (US); Chad J. Gartzke, Richfield, WI (US); Carl Tiefenthaler, Jackson, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 280 days.

(21) Appl. No.: 13/187,285

(22) Filed: Jul. 20, 2011

(65) Prior Publication Data

US 2013/0019822 A1 Jan. 24, 2013

(51) Int. Cl.

| | |
|---|---|
| ***F02N 3/02*** | (2006.01) |
| ***F01P 1/00*** | (2006.01) |
| ***F02F 7/00*** | (2006.01) |

(52) U.S. Cl.
USPC ..... 123/185.3; 123/195 C; 123/41.7

(58) Field of Classification Search
USPC ..... 123/41.65, 41.7, 65 BA, 195 C, 198 E, 123/185.3
See application file for complete search history.

(56) References Cited

U.S. PATENT DOCUMENTS

| | | | | |
|---|---|---|---|---|
| 3,730,162 | A | | 5/1973 | Murase |
| 4,561,386 | A | * | 12/1985 | Tamba et al. ..... 123/41.7 |
| 5,636,606 | A | | 6/1997 | Tsunoda et al. |
| 5,676,103 | A | | 10/1997 | Tsunoda et al. |
| 5,715,783 | A | | 2/1998 | Osakabe et al. |
| 5,862,713 | A | | 1/1999 | Tsunoda et al. |
| D417,675 | S | | 12/1999 | Yaguchi et al. |
| 6,199,529 | B1 | | 3/2001 | Kuwabara et al. |
| 6,240,889 | B1 | | 6/2001 | Kuwabara et al. |
| 6,272,940 | B1 | | 8/2001 | Tsunoda et al. |
| 6,374,791 | B1 | | 4/2002 | Kuwabara et al. |
| 6,418,627 | B1 | | 7/2002 | Tsunoda et al. |
| 6,446,345 | B1 | | 9/2002 | Tsunoda et al. |
| 6,679,217 | B2 | | 1/2004 | Nieda et al. |
| 6,718,931 | B2 | | 4/2004 | Morishige et al. |
| 6,722,336 | B2 | | 4/2004 | Nieda et al. |
| 6,739,303 | B2 | | 5/2004 | Harada et al. |
| 6,755,170 | B2 | | 6/2004 | Morishige et al. |
| 6,792,908 | B1 | | 9/2004 | Shimizu |
| 6,827,055 | B2 | | 12/2004 | Tsunoda et al. |
| 6,901,899 | B2 | | 6/2005 | Tsunoda et al. |
| 6,901,901 | B2 | | 6/2005 | Nieda et al. |
| 6,959,680 | B2 | | 11/2005 | Hashiba |
| 6,971,359 | B2 | | 12/2005 | Tohyama |

(Continued)

FOREIGN PATENT DOCUMENTS

| | | |
|---|---|---|
| SU | 1361367 | 12/1987 |

OTHER PUBLICATIONS

English abstract of RU 2137928 C1, 1 page.

(Continued)

*Primary Examiner* — Hai Huynh
(74) *Attorney, Agent, or Firm* — Foley & Lardner LLP

(57) ABSTRACT

An engine includes an engine cover, a blower fan, and a recoil starter having a cover. The engine cover includes an inlet aperture and is configured to house working components of the engine. The blower fan is configured to disperse air received through the inlet aperture to cool the working components of the engine. The recoil starter cover has an opening for air to pass through and is fastened to the underside of the engine cover.

20 Claims, 7 Drawing Sheets

(56) References Cited

U.S. PATENT DOCUMENTS

| | | | | |
|---|---|---|---|---|
| 6,981,482 | B2 | 1/2006 | Tsunoda et al. | |
| 7,032,558 | B2 | 4/2006 | Nieda et al. | |
| 7,069,896 | B2 | 7/2006 | Tsunoda et al. | |
| 7,093,577 | B2 | 8/2006 | Tohyama | |
| 7,128,041 | B2 | 10/2006 | Hashiba | |
| 7,174,874 | B2 | 2/2007 | Horikoshi | |
| 7,201,130 | B2 | 4/2007 | Hashiba | |
| 7,213,561 | B2 | 5/2007 | Hashiba | |
| 7,409,942 | B2 | 8/2008 | Hashiba | |
| 7,458,355 | B2 | 12/2008 | Fujita et al. | |
| 7,571,659 | B2 | 8/2009 | Horikoshi | |
| 7,621,246 | B2 | 11/2009 | Tohyama | |
| 7,699,902 | B2 * | 4/2010 | Ohsawa et al. | 55/385.1 |
| 8,166,947 | B2 * | 5/2012 | Hashiba et al. | 123/185.3 |
| 8,424,498 | B2 * | 4/2013 | Tiefenthaler et al. | 123/41.65 |
| 2009/0044769 | A1 | 2/2009 | Kubo et al. | |
| 2010/0162985 | A1 | 7/2010 | Hashiba et al. | |

OTHER PUBLICATIONS

International Search Report and Written Opinion for International Application No. PCT/US12/46363, mail date Oct. 4, 2012, 8 pages.

* cited by examiner

RECOIL STARTER ASSEMBLY FOR AN ENGINE

BACKGROUND

The present invention relates generally to the field of small, internal combustion engines, such as those engines that may be used to power outdoor power equipment including, for example, walk-behind lawn mowers, snow throwers, and pressure washers. More specifically, the present invention relates to the engine cover, the recoil starter, and the air cooling system of an engine.

Small, internal combustion engines often include a recoil starter. An operator pulls a rope attached to a wheel coupled to the crankshaft of the engine, to rotate the crankshaft. Rotation of the crankshaft, in turn, initiates combustion processes of the engine by facilitating the movement of air and fuel through the engine and simultaneously producing sparks in the combustion chamber via the ignition system of the engine. Typically the recoil starter further includes an automatic rewind in the form of a torsion spring that recoils the rope after the operator has completed a pull. In some cases, the engine may require several pulls to start. When the engine is running fast enough, the combustion processes automatically drive the crankshaft without assistance from the recoil starter.

During manufacturing of the engine, installation of the recoil starter may take significant time and effort. In some instances, the recoil starter may be manually screwed onto the top of an engine. In such cases, the number and strength of the screws must be strong enough to hold the recoil starter to the top of the engine when the operator is pulling the rope.

SUMMARY

One embodiment of the invention relates to an engine, which includes an engine cover, a blower fan, and a recoil starter having a cover. The engine cover includes an inlet aperture and is configured to house working components of the engine. The blower fan is configured to disperse air received through the inlet aperture to cool the working components of the engine. The recoil starter cover has an opening for air to pass through and is fastened to the underside of the engine cover.

Another embodiment of the invention relates to an engine, which includes an engine cover, a recoil starter having a cover, a blower fan, and an air deflector. The engine cover includes an inlet aperture and is configured to house working components of the engine. The recoil starter cover has an opening for air to pass through and is configured to span the inlet aperture of the engine cover. The blower fan is configured to disperse air received through the inlet aperture to cool the working components of the engine. The air deflector is configured to be positioned proximate to the underside of the recoil starter cover and to extend from a rim of the inlet aperture toward the center of the inlet aperture, partially over the inlet aperture. The air deflector helps direct air dispersed by the blower fan toward the working components of the engine.

Yet another embodiment of the invention relates to a method of manufacturing an engine. The method includes fastening a recoil starter to an underside of an engine cover such that the recoil starter spans an inlet aperture of the engine cover. Contact between the underside of the engine cover and the recoil starter provides a load-bearing interface during starting of the engine.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
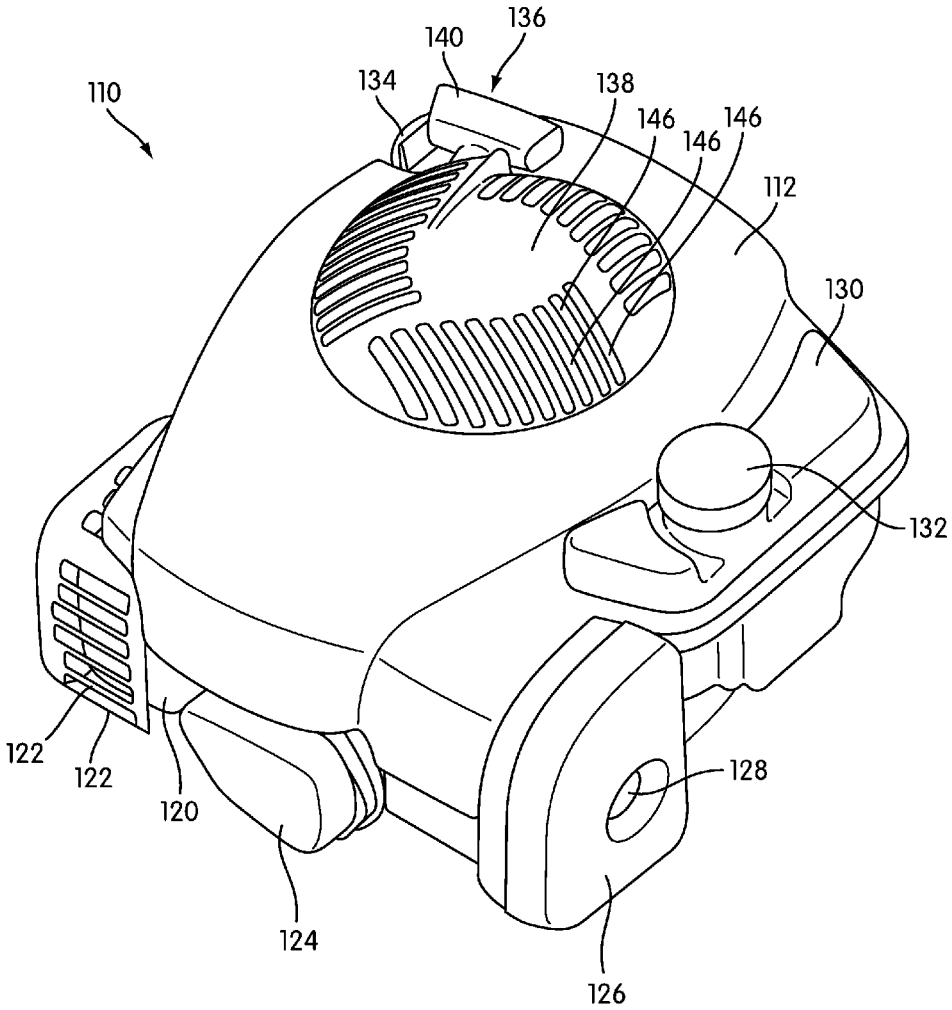
FIG. 1 is perspective view of an engine according to an exemplary embodiment of the invention.
Figure 2:
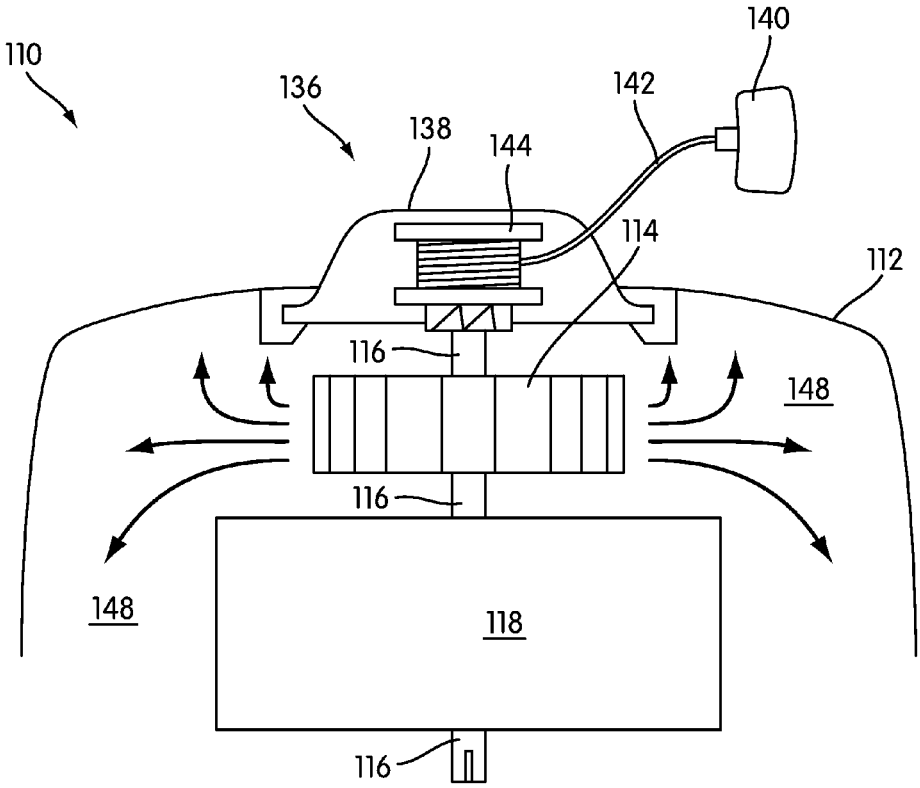
FIG. 2 is a schematic diagram of an engine, such as the engine of FIG. 1, according to an exemplary embodiment of the invention.

Referring to FIGS. 1-2, an engine 110 includes an engine cover 112 (e.g., shroud) configured to house working components of the engine 110, such as a blower fan 114 (e.g., combination fan and flywheel), a crankshaft 116, a crankcase 118, or other components. The engine 110 further includes a muffler 120 and heat shield 122, a cover 124 for rocker arms of an overhead valve system, an air intake 126 with primer bulb 128, a gas tank 130 and cap 132, a cap 134 for an oil chute, and a recoil starter assembly 136.

The recoil starter assembly 136 includes a cover 138 (e.g., recoil starter cover), a handle 140 connected to a rope 142, and a spool 144 (e.g., wheel, sheave) for the rope 142. The spool 144 is coupled to the crankshaft 116 of the engine 110. To start the engine, an operator pulls the rope 142 to rotate the crankshaft 116 and initiate combustion processes of the engine 110. According to an exemplary embodiment, the recoil starter cover 138 includes openings 146 through which air may pass into the interior 148 of the engine cover 112 to be dispersed by the blower fan 114 to cool the working components of the engine 110.

The recoil starter assembly 136 may be coupled to the crankshaft 116 in a variety of different ways, such as directly, using a ratcheting member, or indirectly via intermediate gearing, with or without a ratcheting member. According to an exemplary embodiment, a ratchet (e.g., including "dogs") of the rewind extends, engages, and rotates a starter cup when the rewind rope is pulled. The starter cup then communicates the rotation to the crankshaft. When the rope is subsequently released, the rope automatically rewinds and the ratchet retracts and disengages the starter cup. In other embodiments, other connection systems and features may be used, such as a clutch to selectively engage the starter with the crankshaft.

According to an exemplary embodiment, the engine 110 is a small, internal combustion engine designed for outdoor power equipment, such as walk-behind lawn mowers, snow throwers, pressure washers, portable generators, go-carts, rotary tillers, and other such equipment. In some embodiments, the engine 110 is vertically shafted; while in other embodiments, the engine is horizontally shafted. The engine 110 may include one or more cylinders, and may operate on a two- or four-stroke cycle. In contemplated embodiments, the engine 110 may include an electric starter motor with an air intake piece for the blower fan in place of the recoil starter cover 138 shown in FIGS. 1-2, where the air intake piece is fastened to the engine cover 112 according to teachings disclosed herein.

Figure 3:
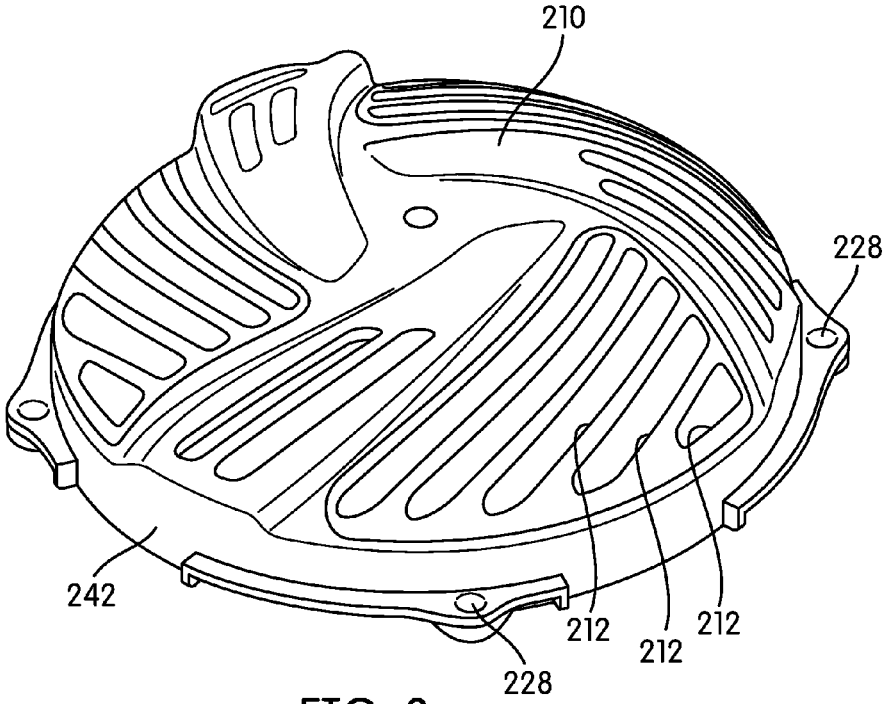
FIG. 3 is a perspective view of a cover for a recoil starter according to an exemplary embodiment of the invention.

Referring now to FIG. 3, a recoil starter cover 210 has a generally round shape and includes openings 212 through which air may pass. In other embodiments, the shape of the recoil starter cover is square, polygonal, or otherwise shaped. The openings 212 may be of various shapes and configurations, including a mesh or screen. According to an exemplary embodiment, the recoil starter cover 210 is formed from a single continuous material, such as injection molded from plastic or stamped from metal. In some embodiments, the recoil starter cover 210 includes a boss 214 (e.g., pin) for a spool (see, e.g., spool 144 as shown in FIG. 2), where the boss 214 may be integrally formed with the recoil starter cover 210 or simply fastened thereto.

Figure 4:
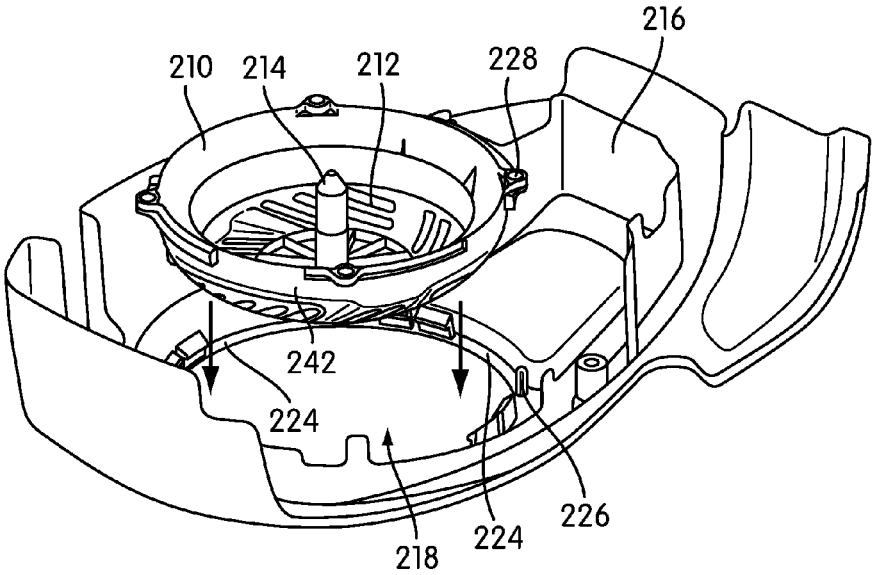
FIG. 4 is a exploded view of the recoil starter cover of FIG. 3 being inserted into an engine cover according to an exemplary embodiment of the invention.

Referring to FIG. 4, the recoil starter cover 210 is configured to be fastened to an engine cover 216, which is shown in an upside-down orientation in FIG. 4. The engine cover 216 includes an intake aperture 218 (e.g., opening, hole) in the center of the top of the engine cover 216, above the crankshaft (see, e.g., crankshaft 116 as shown in FIG. 2). The recoil starter cover 210 is configured to be fastened to the underside 220 (e.g., engine-side, bottom) of the engine cover 216, as shown in FIG. 4, such that the recoil starter cover 210 spans (e.g., fills, is positioned within) and extends through the intake aperture 218. In other contemplated embodiments, an intake aperture may be elsewhere positioned in the engine cover.

According to an exemplary embodiment, the recoil starter cover 210 includes a flange 222 (e.g., lip, extension) projecting outward from a side of the recoil starter cover 210. The flange 222 is sized to be wider than the intake aperture 218, preventing the recoil starter cover 210 from passing fully through the intake aperture 218 when inserted from the underside 220 of the engine cover 216. The flange 222 is then configured to contact a rim 224 of the intake aperture 218. In contemplated embodiments, the contact may be indirect, such as in cases where a gasket, glue, or other intermediate element is positioned between the flange 222 and rim 224, such as to establish an air seal or to fasten the flange 222 and rim 224 together. Contact between the rim 224 and flange 222 provides a load-bearing interface during operation of the recoil starter, which may be stronger or more reliable than interfaces provided by other fastening methods, such as gluing, screwing, clipping, etc. the recoil starter to the top of the engine cover. The load-bearing interface may help to keep the recoil starter cover attached to the engine despite loading caused by operation of the recoil starter. However, in contemplated embodiments, the recoil starter cover may be fastened to the top of the engine cover via other such fastening methods.

Figure 5:
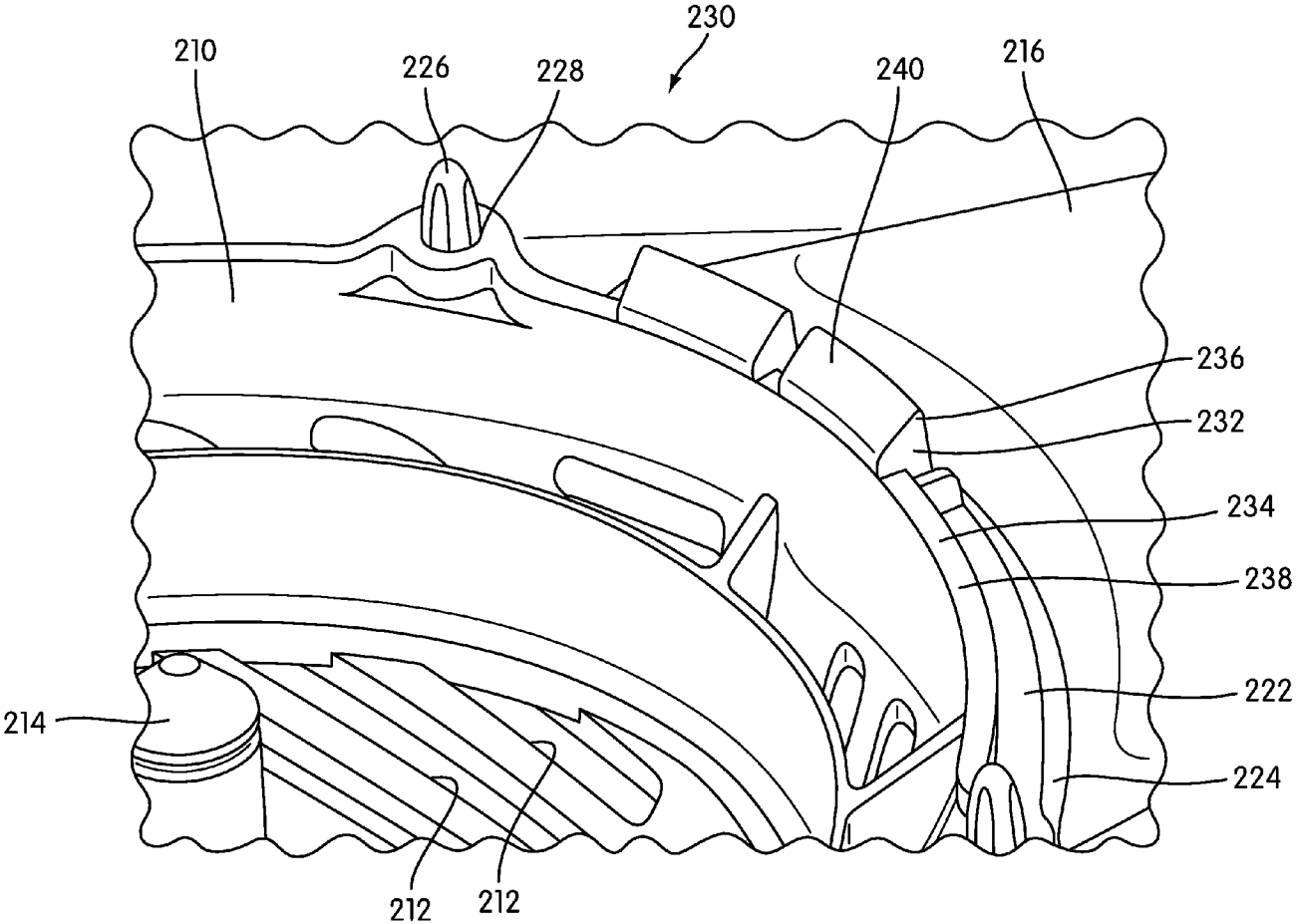
FIG. 5 is a perspective view of portions of the recoil starter cover of FIG. 3 and engine cover of FIG. 4 fastened together.

Referring to FIGS. 4-5, the engine cover 216 and recoil starter cover 210 include a fastening system 230 (FIG. 5) for attachment of the recoil starter cover 210 to the engine cover 216. In some embodiments, the fastening system 230 includes first and second parts 232, 234, where one of the parts 232 is integrally formed with the engine cover 216 (e.g., molded with, stamped with, of the same continuous body) and the other of the parts 234 is integrally formed with the recoil starter cover 210. Integrally forming the parts 232, 234 of the fastening system 230 with the engine cover 216 and recoil starter cover 210 may reduce the need for additional fastening components (e.g., screws, washers, nuts, bolts, glue) which may get lost, fall out, take extra time to install or remove, etc. However, in other embodiments, the engine cover 216 and recoil starter cover 210 may be fastened together with fastening components that are not integrally connected to the engine cover 216 or recoil starter cover 210.

In some embodiments, the first and second parts 232, 234 of the fastening system 230 include a hook 236 and a receiving surface 238 (e.g., catch, ledge) for the hook 236. The hook 236 may face toward the center of the intake aperture 218, away therefrom, or may be otherwise oriented, where the receiving surface 238 is correspondingly oriented to receive the hook 236. In some embodiments, the receiving surface 238 is the bottom rim of the recoil starter cover 210. In other embodiments, the receiving surface is a hole, a groove, or part of a flange or extension from the side of the recoil starter cover 210. As shown in FIG. 4, the fastening system 230 may include more than one hook 236, such as three or more hooks 236 positioned around the intake aperture 218; or in other contemplated embodiments, around the outer periphery of the recoil starter cover 210.

According to an exemplary embodiment, the top 240 of the hook 236 includes an inclined surface. As such, movement of the recoil starter cover 210 into the intake aperture 218 of the engine cover 216, during assembly of the engine, provides an orthogonal component to the contact force between the top 240 of the hook 236 and a contacting surface 242. The orthogonal component causes the hook 236 to temporarily deflect (e.g., flex, move out of the way of), allowing the recoil starter cover 210 to pass into a fastened position in the intake aperture 218 of the engine cover 216, as shown in FIG. 5. In contemplated embodiments, the surface 242 contacting the top 240 of the hook 236 may also deflect. Alternatively, the contacting surface may be inclined and deflect, while the top of the hook may not be inclined. Once the recoil starter has passed to the fastened position, the hook 236 then engages the receiving surface 238. To detach the recoil starter cover 210 from the engine cover 216, the hook 236 may be manually deflected and the recoil starter cover 210 may then be lifted away from the engine cover 216.

According to an exemplary embodiment, the hook 236 of the first part 232 of the fastening system 230 is part of the engine cover 216, and the receiving surface 238 of the second part 234 of the fastening system 230 is on the recoil starter cover 210. In other embodiments, positioning of the hook and receiving surface is reversed. In still other embodiments, each of the engine cover and recoil starter cover includes a hook and a receiving surface.

In some embodiments, guide structures, such as pins 226 and corresponding holes 228, may be used with the fastening system 230 to guide the attachment of the recoil starter cover 210 to the engine cover 216. In other embodiments, pins may be used to facilitate heat staking of the recoil starter cover to the engine cover. In still other embodiments, pins or other guide structures are not included (see generally FIGS. 6-8).

Figure 6:
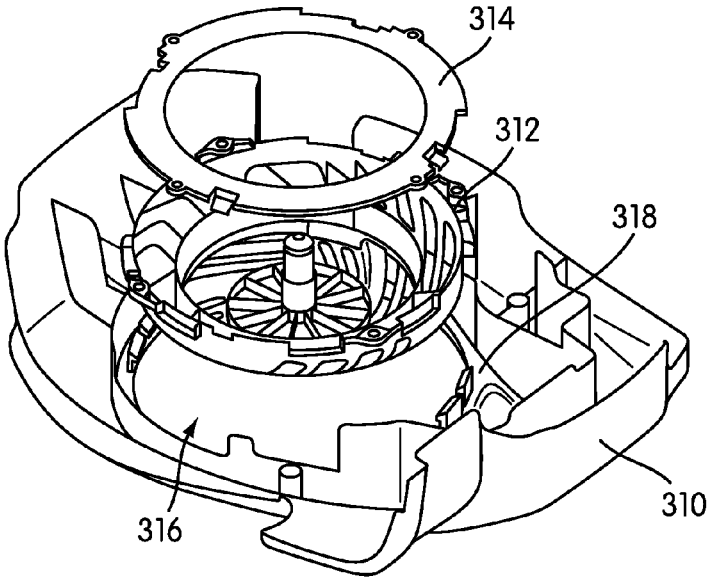
FIG. 6 is an exploded view of a recoil starter cover and an air deflector being inserted into an engine cover according to an exemplary embodiment of the invention.
Figure 7:
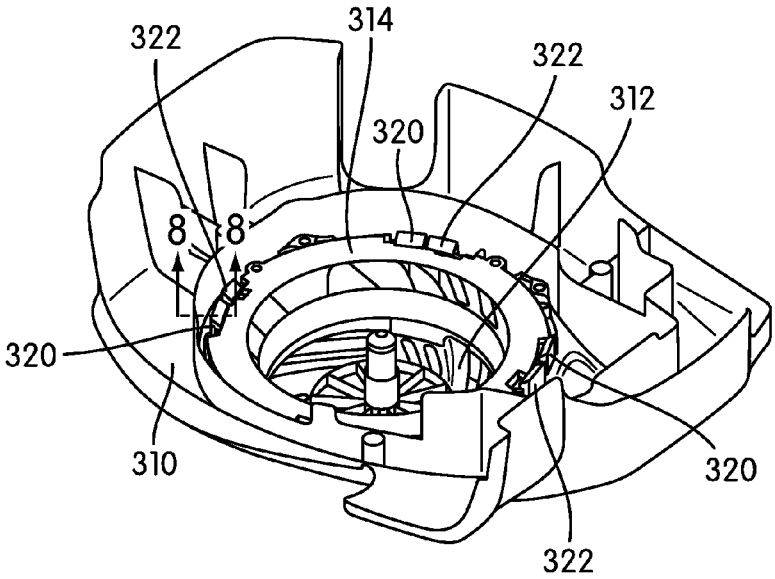
FIG. 7 is a perspective view of the recoil starter cover, air deflector, and engine cover of FIG. 6 fastened together.
Figure 8:
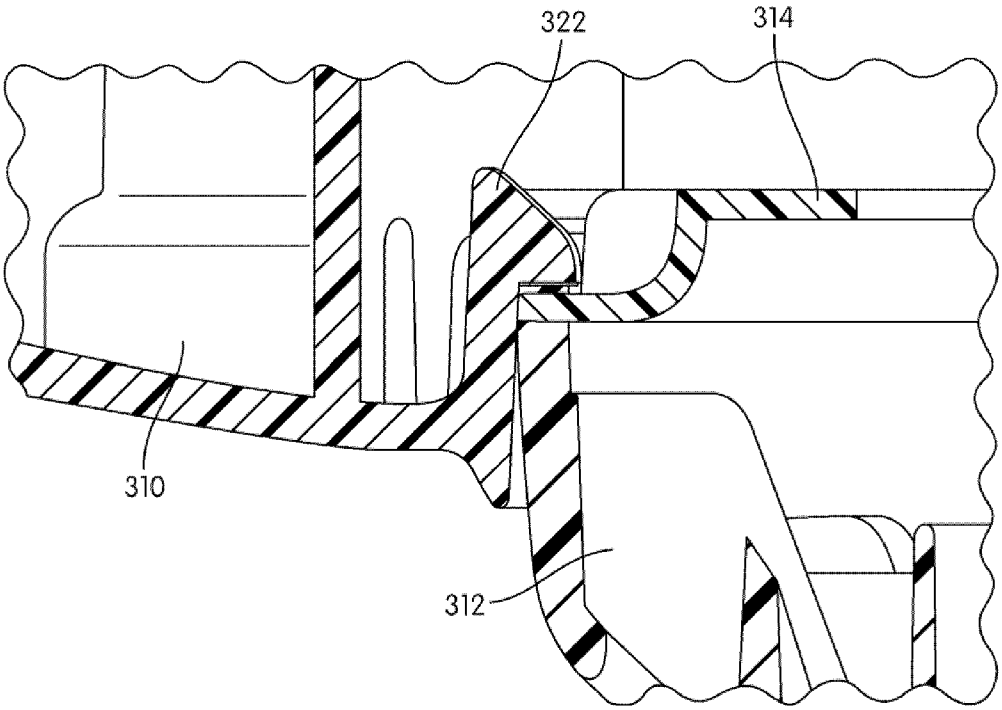
FIG. 8 is a sectional view of portions of the recoil starter cover, air deflector, and engine cover of FIG. 6 fastened together, taken along line 8-8 of FIG. 7.

Referring now to FIGS. 6-8, an engine cover 310, recoil starter cover 312, and air deflector 314 (e.g., cooling ring) may be fastened together (FIG. 7). According to an exemplary embodiment, the recoil starter cover 312 may be fastened into a position spanning an intake aperture 316 in the engine cover 310. The air deflector 314 may be fastened proximate to (e.g., adjacent to) the recoil starter cover 312 such that the recoil starter cover 312 is between the air deflector 314 and a rim 318 of the intake aperture 316 of the engine cover 310.

The air deflector 314 shown in FIGS. 6-8 generally extends from the rim 318 of the intake aperture 316 toward the center of the intake aperture 316. In embodiments using a centrifugal blower fan (see, e.g., blower fan 114 as shown in FIG. 2), air flow generated beneath the engine cover 310 by the blower fan may be at a higher pressure proximate to the sides of the engine, as opposed to the center of the engine below the intake aperture 316 (see generally FIG. 2). However, without the air deflector, some air flow provided by the blower fan may flow out of the intake aperture 316, especially close to the rim 318 of the intake aperture 316, reducing the amount of cooling air directed to the working components of the engine. Accordingly, the air deflector 314 is configured to help direct air dispersed by the blower fan toward the working components of the engine by limiting (e.g., reducing) the flow of air out of the intake aperture 316.

In some embodiments, the intake aperture 316 is round and the air deflector 314 extends from the rim 318 of the intake aperture 316 toward the center of the intake aperture 316 a distance that is less than half the radius of the intake aperture 316, providing an opening through the center of the intake aperture 316 with sufficient area for air to flow through the intake aperture 316 to the blower fan to cool the engine. However, in some embodiments, the air deflector 314 extends at least an eighth of the radius, such as about a quarter of the radius, from the rim 318 toward the center of the intake aperture 316 in order to sufficiently limit air flow out of the intake aperture 316. In other embodiments, an air deflector extends further than half the radius toward the center or less than an eighth of the radius toward the center.

According to an exemplary embodiment, the air deflector 314 extends around the full periphery of the intake aperture 316. In other embodiments, the air deflector extends only partially around the periphery of the air intake, such as around portions of the periphery corresponding to the rear and lateral sides of the engine. In contemplated embodiments, the air deflector may not be round.

Referring to FIG. 8, the air deflector 314 may be fastened to the engine cover 310 in a manner as described above with regard to the attachment of the recoil starter cover 210 to the engine cover 216 (see FIG. 5). In some such embodiments, the recoil starter cover 312 is fastened to the engine cover 310 with one set of hooks 320 and the air deflector 314 is fastened on top of the recoil starter cover 312 with a second set of hooks 322, so that the air deflector 314 is configured to be inserted and removed from the engine cover 310 separately from the recoil starter cover 312. In other contemplated embodiments, the air deflector may be engaged by the same hooks that engage the receiving surface on the recoil starter cover. In still other embodiments, the air deflector may be heat staked, glued, or otherwise fastened to the engine cover, the recoil starter cover, or both. In some contemplated embodiments, the air deflector is integrated with (e.g., fastened to, integrally formed with) the recoil starter cover prior to attachment of either the recoil starter cover or the air deflector to the engine cover.

In the embodiment shown in FIGS. 6-8, pins and corresponding holes in the recoil starter cover and air deflector, or other such guide or fastening structures, are not included. By contrast, the embodiment in FIGS. 9-10 includes a guiding structure for an air deflector 422 in the form of bosses 410 that are integrally formed with and extend from a recoil starter cover 412. The bosses 410 engage corresponding holes in the air deflector 422 during assembly.

Figure 9:
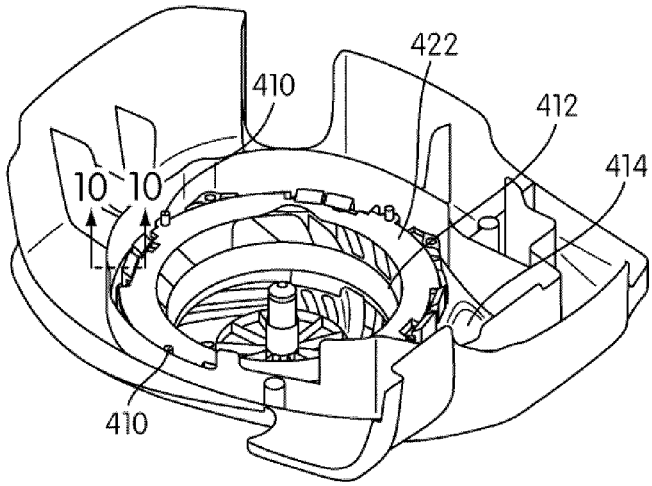
FIG. 9 is a perspective view of a recoil starter cover, air deflector, and engine cover fastened together according to another exemplary embodiment of the invention.
Figure 10:
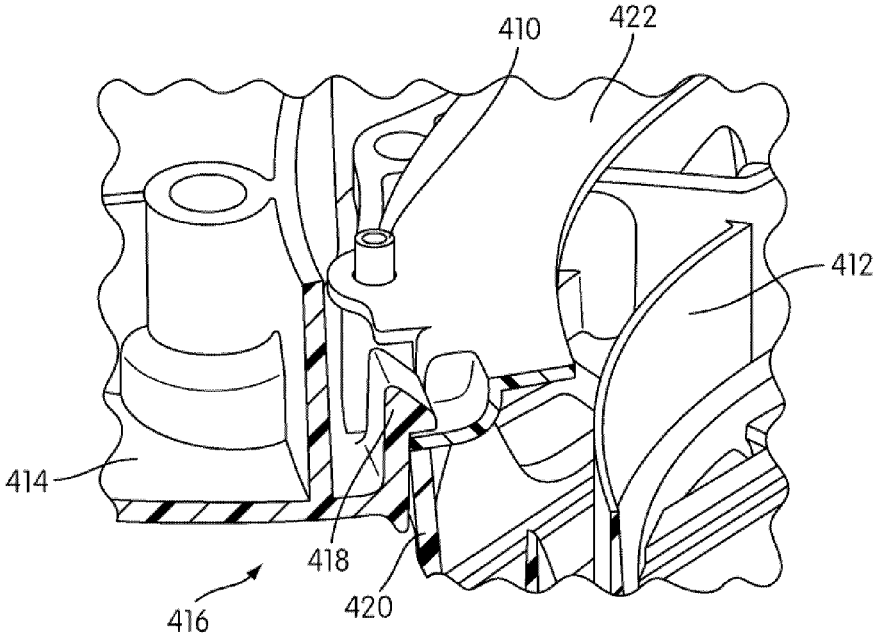
FIG. 10 is a sectional view of portions of the recoil starter cover, air deflector, and engine cover of FIG. 9 fastened together, taken along line 10-10 of FIG. 9.

Still referring to FIGS. 9-10, a method of manufacturing an engine includes fastening the recoil starter cover 412 to an underside of an engine cover 414 of the engine such that the recoil starter cover 412 spans an inlet aperture of the engine cover 414. Contact between the underside of the engine cover 414 and the recoil starter cover 412 provides a load-bearing interface during operation of the recoil starter.

A fastening system 416 may be used for fastening the recoil starter cover 412 to the underside of the engine cover 414 by engaging a hook 418 with a receiving surface 420. The hook 418, in some embodiments, is integrally formed with one of the recoil starter cover 412 and the engine cover 414, while the receiving surface 420 is integrally formed with the other of the recoil starter cover 412 and the engine cover 414.

In some embodiments, the manufacturing method further includes fastening the air deflector 422, as described above, proximate to an underside of the recoil starter cover 412. The air deflector 422 extends from a rim of the inlet aperture toward the center of the inlet aperture, partially over the inlet aperture. Accordingly, the air deflector 422 helps to direct air dispersed by a blower fan of the engine toward working components of the engine.

The construction and arrangements of the engine, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine, comprising:

an engine cover configured to house working components of the engine, wherein the engine cover comprises an inlet aperture;

a blower fan configured to disperse air received through the inlet aperture to cool the working components of the engine; and a recoil starter having a cover with an opening for air to pass through, wherein the recoil starter cover extends through the inlet aperture from the underside of the engine cover.

2. The engine of claim 1, further comprising a fastening system for attachment of the recoil starter cover to the engine cover, wherein the engine cover comprises a first part of the fastening system that is integrally formed with the engine cover, and wherein the recoil starter cover comprises a second part of the fastening system that is integrally formed with the recoil starter cover.

3. The engine of claim 2, wherein one of the first and second parts comprises a hook, and wherein the other of the first and second parts comprises a receiving surface for engaging the hook to fasten the recoil starter cover to the underside of the engine cover.

4. The engine of claim 3, wherein a top of the hook is inclined toward a distal end of the hook, and wherein the other of the first and second parts further comprises a contact surface for contacting the top of the hook during fastening of the recoil starter cover to the underside of the engine cover such that the hook flexes as the first and second parts engage one another.

5. The engine of claim 4, wherein the engine cover includes the hook and the recoil starter cover includes the receiving surface.

6. The engine of claim 5, wherein the recoil starter cover further comprises a flange extending laterally from a side of the recoil starter cover.

7. The engine of claim 6, wherein the engine cover further comprises a rim of the inlet aperture, and wherein the flange of the recoil starter cover is constrained between the hook and the rim, whereby contact between the rim and the flange provides a load-bearing interface during starting of the engine.

8. The engine of claim 7, further comprising an air deflector proximate to the recoil starter cover and extending from the rim of the inlet aperture toward the center of the inlet aperture, partially over the inlet aperture.

9. The engine of claim 8, wherein the recoil starter cover is fastened between the air deflector and the rim of the inlet aperture of the engine cover.

10. The engine of claim 9, wherein the air deflector is fastened to the underside of the engine cover.

11. The engine of claim 10, wherein the engine cover further comprises an additional hook for the air deflector that is configured to engage a receiving surface of the air deflector, whereby the air deflector is configured to be inserted and removed from the engine cover separately from the recoil starter cover.

12. An engine, comprising:

an engine cover configured to house working components of the engine, wherein the engine cover comprises an inlet aperture;

a recoil starter having a cover configured to span the inlet aperture of the engine cover and to extend through the inlet aperture from the underside of the engine cover, wherein the recoil starter cover has an opening for air to pass through;

a blower fan configured to disperse air received through the inlet aperture to cool the working components of the engine; and an air deflector configured to be positioned proximate to the underside of the recoil starter cover and to extend from a rim of the inlet aperture toward the center of the inlet aperture, partially over the inlet aperture, whereby the air deflector directs air dispersed by the blower fan toward the working components of the engine.

13. The engine of claim 12, wherein the air deflector extends fully around the rim of the inlet aperture.

14. The engine of claim 12, wherein the air deflector is fastened to at least one of the engine cover and the recoil starter cover from an underside thereof.

15. The engine of claim 14, wherein the recoil starter cover is fastened to the underside of the engine cover.

16. The engine of claim 15, wherein the recoil starter cover is fastened between the air deflector and the rim of the inlet aperture of the engine cover.

17. The engine of claim 16, wherein the air deflector is hooked to the underside of the engine cover.

18. A method of manufacturing an engine, comprising fastening a recoil starter to an underside of an engine cover such that the recoil starter spans an inlet aperture of the engine cover and extends through the inlet aperture from the underside of the engine cover, whereby contact between the underside of the engine cover and the recoil starter provides a load-bearing interface during starting of the engine.

19. The method of claim 18, further comprising using a fastening system for fastening the recoil starter to the underside of the engine cover by engaging a hook, which is integrally formed with one of the recoil starter and the engine cover, with a receiving surface of the other of the recoil starter and the engine cover.

20. The method of claim 19, further comprising fastening an air deflector proximate to an underside of a cover of the recoil starter, wherein the air deflector then extends from a rim of the inlet aperture toward the center of the inlet aperture, partially over the inlet aperture, whereby the air deflector facilitates direction of air dispersed by a blower fan of the engine toward working components of the engine.

* * * * *